United States Patent [19]

Dreier

[11] Patent Number: 5,038,958

[45] Date of Patent: Aug. 13, 1991

[54] VENTED MICROSCALE CENTRIFUGE TUBE

[75] Inventor: Gustav H. Dreier, Stoughton, Mass.

[73] Assignee: Norfolk Scientific, Inc., Norwood, Mass.

[21] Appl. No.: 487,525

[22] Filed: Mar. 2, 1990

[51] Int. Cl.[5] ..... B65D 51/16; B01L 3/00

[52] U.S. Cl. ..... 220/366; 215/355; 220/DIG. 27; 422/102

[58] Field of Search ..... 215/366, 365, DIG. 27, ~~215~~/DIG. 3, 307, 31, 355, 248; 73/864.51; 220/354, 360, 366; 53/403, 405; 128/763; 604/415; 422/102, 104, 72

[56] References Cited

U.S. PATENT DOCUMENTS

| | | | |
|---|---|---|---|
| 600,064 | 3/1898 | Chaplen et al. | 215/31 |
| 2,367,908 | 1/1945 | Walsh et al. | 215/31 |
| 4,065,018 | 12/1977 | Megowen et al. | 215/355 |
| 4,192,429 | 3/1980 | Yerman | 215/307 |
| 4,227,620 | 10/1980 | Conway | 215/355 |
| 4,483,616 | 11/1984 | Liston et al. | 422/102 |
| 4,576,595 | 3/1986 | Aas et al. | 128/763 |
| 4,758,409 | 7/1988 | Uffenheimer | 73/864.51 |
| 4,785,953 | 3/1988 | Buchholz et al. | 215/365 |

*Primary Examiner*—Stephen Marcus
*Assistant Examiner*—Paul Schwarz
*Attorney, Agent, or Firm*—Weingarten, Schurgin, Gagnebin & Hayes

[57] ABSTRACT

A sealable vented microscale centrifuge tube for centrifuging samples at substantially atmospheric pressure, thus avoiding the danger of backpressure in the stoppered centrifuge tube which may expel the cap or shatter the tube during centrifugation. The device of the invention includes a container having a wall defining a cavity capable of holding a sample; a flange surrounding the cavity opening and possessing a hole; and a shell which surrounds the flange and which extends above and below its plane, and is attached to the flange rim, thus supporting the container within the shell. It additionally includes a removable cap which seals the cavity of the container. When the cavity of the container is sealed by the removable cap, air which would otherwise be compressed in the container is vented through the hole through the flange of the container and into the space between the container wall and the supporting shell.

4 Claims, 2 Drawing Sheets

VENTED MICROSCALE CENTRIFUGE TUBE

FIELD OF THE INVENTION

This invention relates to centrifuge tubes and more particularly to a vented microcentrifuge tube.

BACKGROUND OF THE INVENTION

One of the most common procedures performed in a research or clinical laboratory is the centrifugation of a sample. Centrifuge tubes are well known in the art and exist in a variety of shapes and sizes. The type of centrifuge tube used for a particular procedure depends on a variety of factors such as the size of the sample, the speed at which the sample is to be centrifuged, and the type of centrifuge rotor necessary for centrifugation. It is frequently necessary to use a centrifuge tube having a cap or cover ~~to~~ seal the sample within the tube to prevent spillage or contamination of the sample during the centrifugation process.

There are many occasions when the size of the sample to be centrifuged is very small. However, it is not always practical to use a very small centrifuge tube for such samples because of the relatively high pressure which results when a small tube is stoppered, which can expell the stopper or break the tub. Either situation is potentially hazardous, especially if the sample contains a dangerous substance which would contaminate the interior of the centrifuge, or if the breakup of a tube would cause the spinning centrifuge to become unbalanced, creating a dangerous situation for anyone near the unit. Therefore, it is usually necessary to use a centrifuge tube which has a sufficiently large capacity so that stoppering results in only a small pressure buildup.

However, using a relatively large centrifuge tube can be cumbersome, especially when working with samples on a microscale level. Therefore it would be desirable to have a microscale centrifuge tube which may be safely used without the dangers of pressure buildup during use.

SUMMARY OF THE INVENTION

The present invention overcomes the problems of the prior art associated with handling and centrifuging of microscale samples. It provides a vented microcentrifuge tube particularly useful for centrifuging microscale samples without the danger of pressure buildup during stoppering. Another feature of the invention is that the microcentrifuge tube is capable of standing upright on a flat surface without a separate support such as a tray or rack, and thus facilitates handling and loading of samples on the microscale level.

Accordingly, the present invention comprises a container having at least one wall and a bottom defining a cavity with one open end; an outwardly-extending flange surrounding the open end of the cavity and attached to the container wall, this flange having a hole through it between its front and rear surfaces; and a shell having at least one wall which surrounds the flange, extends above and below the plane of the flange, and is attached to the flange edge, thus supporting the container within the shell. The shell also has a first open end proximate to the open end of the container cavity, and a second open end proximate to the container bottom. The microcentrifuge tube further is provided with a mating cap which is configured to fit into the first open end of the shell and seat against the flange of the container, to seal the container. Air which would otherwise be compressed when the tube is stoppered is vented through the hole in the flange of the container into the space between the wall of the container and the supporting shell.

In a preferred embodiment of the invention, the cavity of the container is conically shaped and the shell which surrounds the length of the container is a cylinder having open opposite ends. A first end of the cylinder is configured to receive the removable cap which may be pushed or twisted into the end of the cylinder and seated against the flange of the container to seal the cavity. A second end of the supporting shell is configured to stand the cylinder, container and cap upright on a flat surface.

DESCRIPTION OF THE DRAWING

The invention will be more fully understood from the following solely exemplary detailed description taken in conjunction with the accompanying drawings in which.

DETAILED DESCRIPTION OF THE INVENTION

Figure 1:
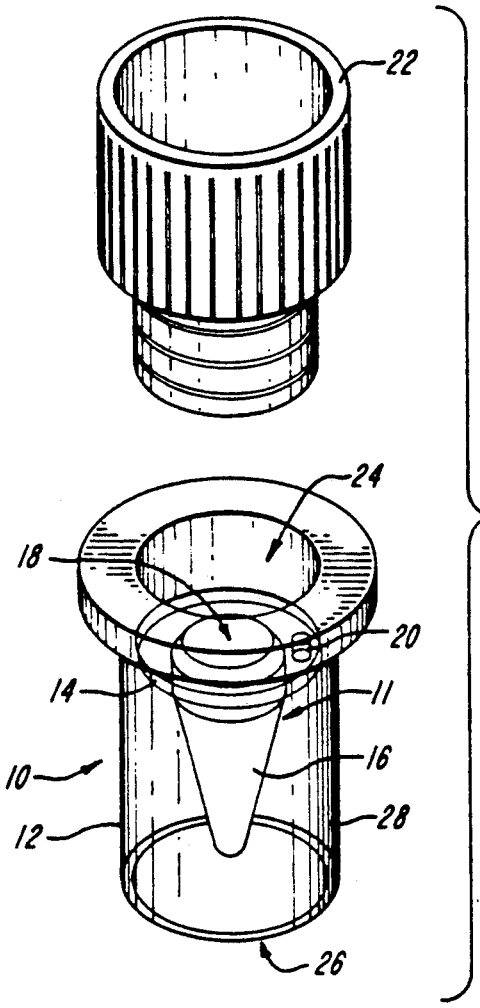
FIG. 1 is a perspective view of the vented microcentrifuge tube and mating cap of the present invention.

Referring now to the drawings wherein like reference numerals designate corresponding elements throughout the several views, one embodiment of a vented microcentrifuge tube is exemplarily illustrated in FIG. 1.

The vented microcentrifuge tube 10 includes a container 11, a shell 12, and a flange 14 which is attached to both container 11 and shell 12.

Container 11 includes a cavity 16 having one open end 18, with flange 14 at the open end 18 of the cavity 16 and extending outward from the container 11. The flange 14 has a hole 20 formed therethrough. A removable cap 22 mates with microcentrifuge tube 10.

The shell 12 includes a first open end 24 and a second open end 26. Shell 12 surrounds the length of the container 11 and is coupled to the container 11 at the flange 14 of cavity 16. An open space 28 remains in the length between the cavity 16 of the container 11 and the shell 12.

The removable cap 22 is configured for insertion into the first open end 24 of the shell 12 and seats against the flange 14 of the container 11 to seal the cavity 16. The flow of air which results when the cavity 16 is sealed by the insertion of the removable cap 22 is vented through the hole 20 formed through the flange 14 of the container and into the open space 28 between the container 11 and the shell 12. This arrangement prevents air from being compressed in the cavity 16.

In the preferred embodiment illustrated in FIG. 1, the cavity 16 of the container 11 is conically shaped and the shell 12 which surrounds the container 11 and which is coupled to the container 11 at the flange 14 is cylindrical in shape. The cylindrical shell 12 is most preferably at least as long as the container 11 in order to support the vented microcentrifuge tube 10 on the second open end 28 of the shell 12 on a flat surface such as a laboratory benchtop (not shown).

In the preferred embodiment, the container 11 and shell 12 are formed of a molded, clear plastic material. The removable cap 22 may be formed of any suitable plastic material and may be clear, opaque or colored as desired.

The capacity of the conical cavity 16 of the container 11 is preferably about 1 ml or less, most preferably, 150 μl or less. However, the tube may be of any reasonable size.

Figure 2:
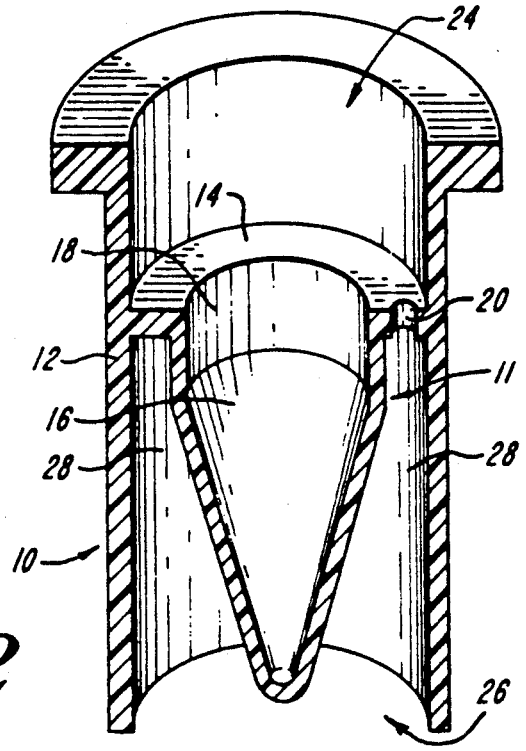
FIG. 2 is a cross sectional view of the tube shown in FIG. 1, the cut having beem made vertically through the tube and through the hole in the flange.

A cross section of the preferred embodiment of the present invention is shown in FIG. 2. This cross section clearly shows the hole 20 formed through the flange 14 of the container 11. FIG. 2 also shows the space 28 between the conically shaped cavity 16 and the shell 12 into which air is vented when the cavity 16 is sealed by the removable cap (not shown).

Figure 3:
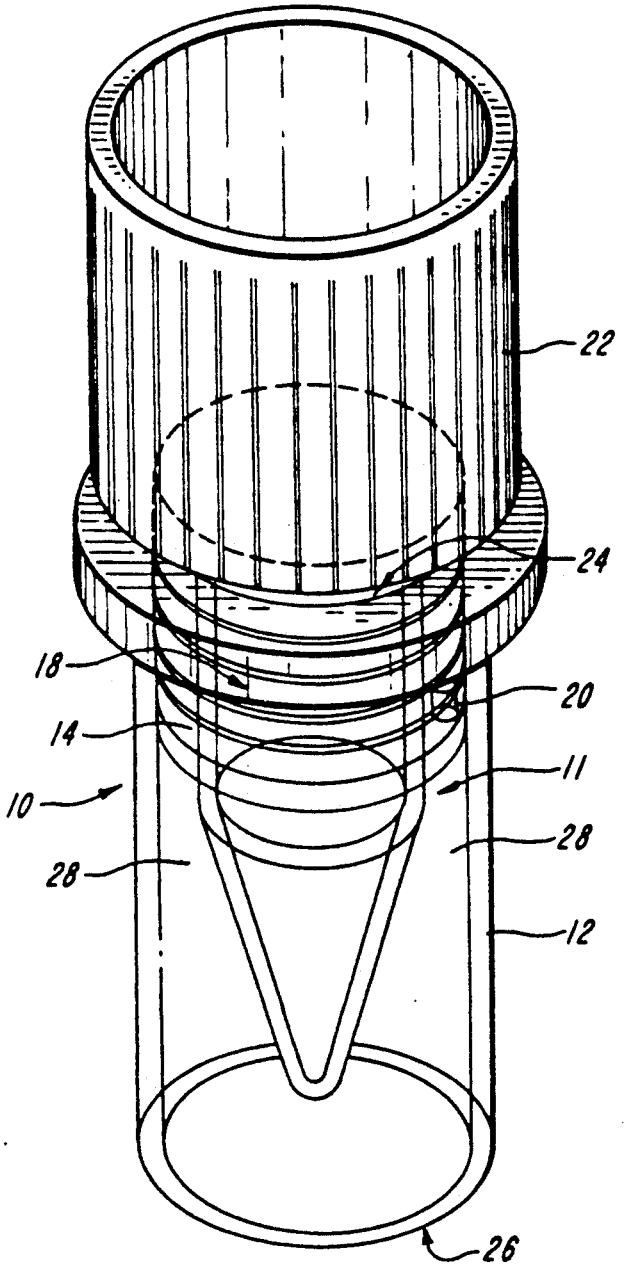
FIG. 3 is a perspective view of the vented microcentrifuge tube of the invention with the cap in place.

In FIG. 3 there is shown the vented microcentrifuge tube of the present invention wiht the cap in place. The removable cap 22 may be a stopper which is pushed into the first open end 24 of the shell 12 until it seats against the flange 14 of the container 11 to seal the cavity 16. The removable cap 22 may alternatively be threaded or possess various protrusions or indentations, which features cooperated with corresponding threads, indentations, or protrusions on the centrifuge tube 10 to hold the cap in place positively. Such features of sealable container are well known to the art.

The invention is not to be limited by what has been particularly shown and described except as indicated by the appended claims.

What is claimed is:

1. A sealable vented microcentrifuge tube comprising:

a container member having at least one wall and a bottom defining a cavity with one open end;

an outwardly extending flange surrounding said open end of said cavity and attached to said container member wall, said flange having a hole formed therethrough; said hole providing a venting path upon the sealing of said open end of said cavity;

a shell member having at least one wall surrounding said flange, extending above and below the plane of said flange, and being attached to the edge of said flange, thus supporting said container member within said shell; said shell further having a first open end proximate to said open end of said container cavity, and a second open end proximate to said container member bottom; and a removable end-closure configured to be inserted into said first open end of said shell member and against said flange of said container member to seal said open end of said container cavity.

2. The vented microcentrifuge tube of claim 1 wherein said cavity of said container member has a conical shape.

3. The vented microcentrifuge tube of claim 1 wherein said shell member has cylindrical shape.

4. The vented microcentrifuge tube of claim 1 wherein said second open end of said shell member is configured to support said vented microcentrifuge tube in an upright position on a flat surface.

* * * * *

UNITED STATES PATENT AND TRADEMARK OFFICE

CERTIFICATE OF CORRECTION

PATENT NO. : 5,038,958

DATED : August 13, 1991

INVENTOR(S) : Gustav H. Dreier

It is certified that error appears in the above-identified patent and that said Letters Patent is hereby corrected as shown below:

Column 1, line 26, "tub" should read --tube--.

Column 2, line 24, "beem" should read --been--.

Column 3, line 18, "wiht" should read --with--.

Column 3, line 24, "cooperated" should read --cooperate--.

Column 3, line 27, "container" should read --containers--.

Column 4, line 26, "has cylindrical" should read --has a cylindrical--.

Signed and Sealed this

Third Day of August, 1993

Michael K. Kirk

MICHAEL K. KIRK

*Acting Commissioner of Patents and Trademarks*

*Attest:*

*Attesting Officer*